US007175169B2

(12) United States Patent
Yonezawa

(10) Patent No.: US 7,175,169 B2
(45) Date of Patent: Feb. 13, 2007

(54) SPRING-LOCK TYPE CLAMP DEVICE

(75) Inventor: Keitaro Yonezawa, Kobe (JP)

(73) Assignee: Kosmek Ltd., Kobe (JP)

( * ) Notice: Subject to any disclaimer, the term of this patent is extended or adjusted under 35 U.S.C. 154(b) by 0 days.

(21) Appl. No.: 10/542,370

(22) PCT Filed: Dec. 18, 2003

(86) PCT No.: PCT/JP03/16215

§ 371 (c)(1),
(2), (4) Date: Jul. 14, 2005

(87) PCT Pub. No.: WO2004/065060

PCT Pub. Date: Aug. 5, 2004

(65) Prior Publication Data

US 2006/0131803 A1 Jun. 22, 2006

(30) Foreign Application Priority Data

Jan. 24, 2003 (JP) ..... 2003-015697

(51) Int. Cl.
*B23Q 3/08* (2006.01)

(52) U.S. Cl. ..... 269/32; 269/228

(58) Field of Classification Search ..... 269/32, 269/20, 24–27, 228
See application file for complete search history.

(56) References Cited

U.S. PATENT DOCUMENTS

| | | | | |
|---|---|---|---|---|
| 5,876,025 | A * | 3/1999 | Yonezawa | 269/24 |
| 5,927,700 | A * | 7/1999 | Yonezawa | 269/24 |
| 6,073,325 | A | 6/2000 | Stark | |
| 6,736,384 | B2 * | 5/2004 | Yokota | 269/32 |
| 2003/0015832 | A1 * | 1/2003 | Kohlert | 269/32 |

FOREIGN PATENT DOCUMENTS

| | | |
|---|---|---|
| JP | 11-170133 | 6/1999 |

* cited by examiner

*Primary Examiner*—Lee D. Wilson
(74) *Attorney, Agent, or Firm*—Bacon & Thomas

(57) ABSTRACT

Into a housing (3) is hermetically inserted an annular piston (5), and into the annular piston (5) is hermetically inserted an output rod (8). A spring (14) located below the piston (5) moves the piston (5) upward for locking, pressurized oil in a release chamber (12) formed above the piston (5) moves the piston (5) downward for releasing. On an upper surface of the piston (5) is provided a pressing surface (38), on an inner periphery of a peripheral wall of the release chamber (12) is provided a first tapered surface (41), which narrows upward, and on an outer periphery of the output rod (8) is provided a second tapered surface (52), which narrows downward. Between the pressing surface (38), the first tapered surface (41) and the second tapered surface (52) are inserted a plurality of balls (55) circumferentially at intervals. Thereby, when the spring (14) moves the piston (5) upward for locking, a moving stroke of the output rod (8) is larger than that of the piston (5).

4 Claims, 4 Drawing Sheets

SPRING-LOCK TYPE CLAMP DEVICE

TECHNICAL FIELD

The present invention relates to a clamping apparatus that locks by an urging force of a spring.

BACKGROUND OF THE INVENTION

This kind of clamping apparatuses is described in Japanese Patent Public Disclosure No. 10-277858, for example.

This prior art is composed so that, during a locking operation, a compression spring composed of a plurality of coned disc springs moves a plurality of balls from a disengaging position to an engaging position, and then the compression spring axially drives an insertion pin via the balls, which are in the engaging position, for locking.

By the way, an urging force of the compression spring is maximized in a fully compressed state, and decreases as the spring expands.

Therefore, in the prior art, the urging force of the compression spring decreases according to an idling stroke for moving the balls from the disengaging positions to the engaging positions. As a result, the urging force for the locking operation decreases, resulting in a small locking force. The larger the idling stroke of the clamping apparatus is, the more conspicuous this problem grows.

It is an object of the present invention to provide a spring-type clamping apparatus having a strong locking force.

SUMMARY OF THE INVENTION

In order to accomplish the object mentioned above, the present invention provides a spring-lock type clamping apparatus, for example, as described below and illustrated in FIG. 1 through FIG. 3 or FIG. 4.

An annular piston 5 is inserted into a housing 3 hermetically and axially movably, and an output member 8 is inserted into the annular piston 5 hermetically and axially movably. A lock chamber 11 is formed between the annular piston 5 and a base end wall 3*a* of the housing 3, and a release chamber 12 is formed between the annular piston 5 and a leading end wall 3*b* of the housing 3. A spring 14 attached to the lock chamber 11 is adapted to move the annular piston 5 toward a leading end for locking, pressurized fluid supplied to the release chamber 12 is adapted to move the annular piston 5 toward a base end for releasing. A pressing surface 38 is provided on a leading end portion of the annular piston 5, a first inclined surface 41, which gets closer to the axis toward the leading end, is provided on an inner periphery of a peripheral wall of the release chamber 12, a second inclined surface 52, which gets closer to the axis toward the base end, is provided on an outer periphery of the output member 8, a plurality of rolling members 55 are inserted between the pressing surface 38, the first inclined surface 41 and the second inclined surface 52 circumferentially at intervals. When the spring 14 moves the annular piston 5 toward the leading end for locking, the pressing surface 38 moves each rolling member 55 toward the leading end and radially inward via the first inclined surface 41, and each rolling member 55 moves the output member 8 toward the leading end via the second inclined surface 52, whereby a moving stroke S2 of the output member 8 is set larger than a moving stroke S1 of the annular piston 5 during the locking movement. It follows that the spring 14 is adapted to press an input surface 53 on an outer periphery of the output member 8 toward the leading end via the pressing surface 38 and the rolling members 55.

It is noted that, it is possible that the first inclined surface 41 is formed by one tapered surface or composed of a plurality of inclined surfaces arranged circumferentially at intervals.

It is also possible that the second inclined surface 52 is formed by one tapered surface or composed of a plurality of inclined surfaces arranged circumferentially at intervals.

Furthermore, it is possible that the pressing surface 38 is formed by a plane, an inclined surface, or a combination of the plane and the inclined surface. It is also possible that the inclined surface is formed by one tapered surface or composed of a plurality of inclined surfaces arranged circumferentially at intervals.

This invention provides the following function and effect.

To switch the clamping apparatus from a released state to a locked state, it is only required to discharge the pressurized fluid in the release chamber and to move the annular piston toward the leading end by an urging force of the spring. Then, the pressing surface of the annular piston moves the output member toward the leading end via the first inclined surface, the rolling members and the second inclined surface, which makes the moving stroke of the output member larger than that of the annular piston. Therefore, an expanding amount of the spring is smaller compared with the moving stroke of the output member. It follows that the spring with a little expanding amount strongly drives the input surface of the output member toward the leading end for locking via the pressing surface and the rolling members.

As described above, when the output member is moved toward the leading end for locking, the expanding amount of the spring is smaller compared with the moving stroke of the output member, which enables a work or the like to be locked with a large urging force of the spring. Thereby, a spring-type clamping apparatus with a strong locking force can be provided.

In addition, the stroke enlargement mechanism composed of the first inclined surface, the rolling members and the second inclined surface is provided in the release chamber, which makes a sliding portion of the stroke enlargement mechanism lubricated using the pressurized fluid, which is supplied to and discharged from the release chamber. Therefore, it is unnecessary to provide a lubrication means only for the stroke enlargement mechanism. It is noted that this advantage becomes remarkable if pressurized oil is employed as the pressurized fluid.

In the present invention, it is preferable that the first inclined surface 41 is formed by a tapered inner peripheral surface, the second inclined surface 52 is formed by a tapered outer peripheral surface and the rolling members 55 are composed of balls or rollers. In this case, the stroke enlargement mechanism can be mechanically simple and inexpensive to manufacture.

Also, it is preferable that the following structure is added to the present invention.

For example, as illustrated in FIG. 1 and FIG. 2, the output member 8 is hermetically inserted into the leading end wall 3*b* of the housing 3, a sectional area of a sealing portion 8*b* of the output member 8 in the leading end wall 3*b* is set to a value smaller than that of a sealing portion 8*a* of the output member 8 in the annular piston 5.

In this invention, the pressure of the pressurized fluid supplied to the release chamber can drive the output member toward the base end for releasing by making this pressure act on an annular sectional area, which corresponds to a difference between two sectional areas of the sealing portions, by which the driving means can be mechanically simple.

Furthermore, it is preferable that the following structure is added to the present invention.

For example, as illustrated in FIG. 1 and FIG. 2, a clamping arm 22 is arranged on the outside of the leading end wall 3*b* of the housing 3, a leading end portion of a link member 23 is rotatably connected to a longitudinal middle portion of the clamping arm 22, a base end portion of the link member 23 is rotatably connected to the leading end wall 3*b*, and an input portion 22*a* of the clamping arm 22 is rotatably connected to an output portion 28 on the leading end of the output member 8.

According to this invention, it is possible to significantly reduce the height of the locking-use spring by applying the present invention to a link-type clamp having an idling stroke that is comparatively larger compared with other types of clamping apparatuses, whereby the link-type clamp can be compact in size.

BEST MODE FOR CARRYING OUT THE INVENTION

Figure 1:
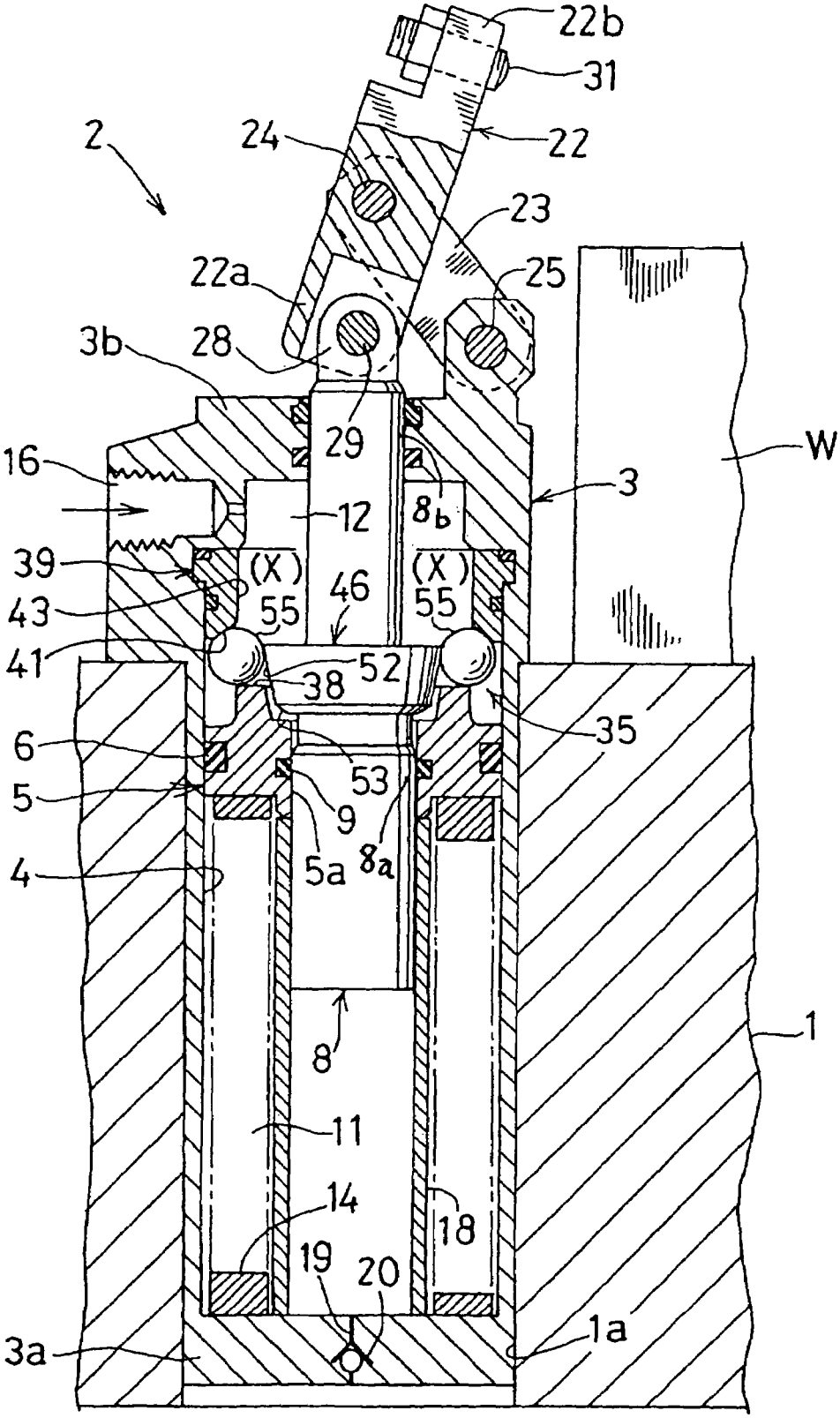
FIG. 1 is an elevational sectional view of a link-type clamp which the present invention is applied to in a released state.
Figure 2:
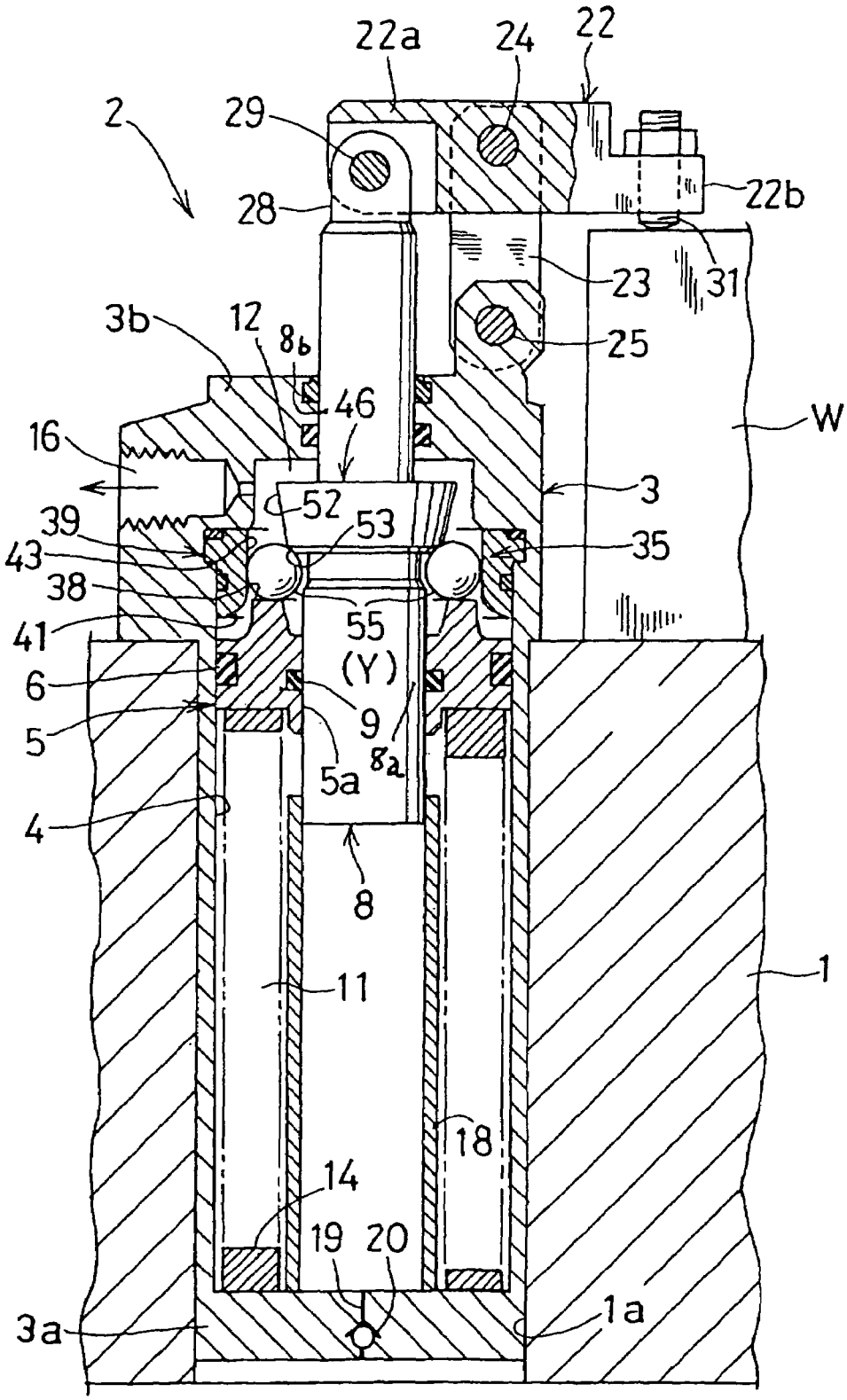
FIG. 2 is a view similar to FIG. 1, illustrating the clamp in a locked state.
Figure 3:
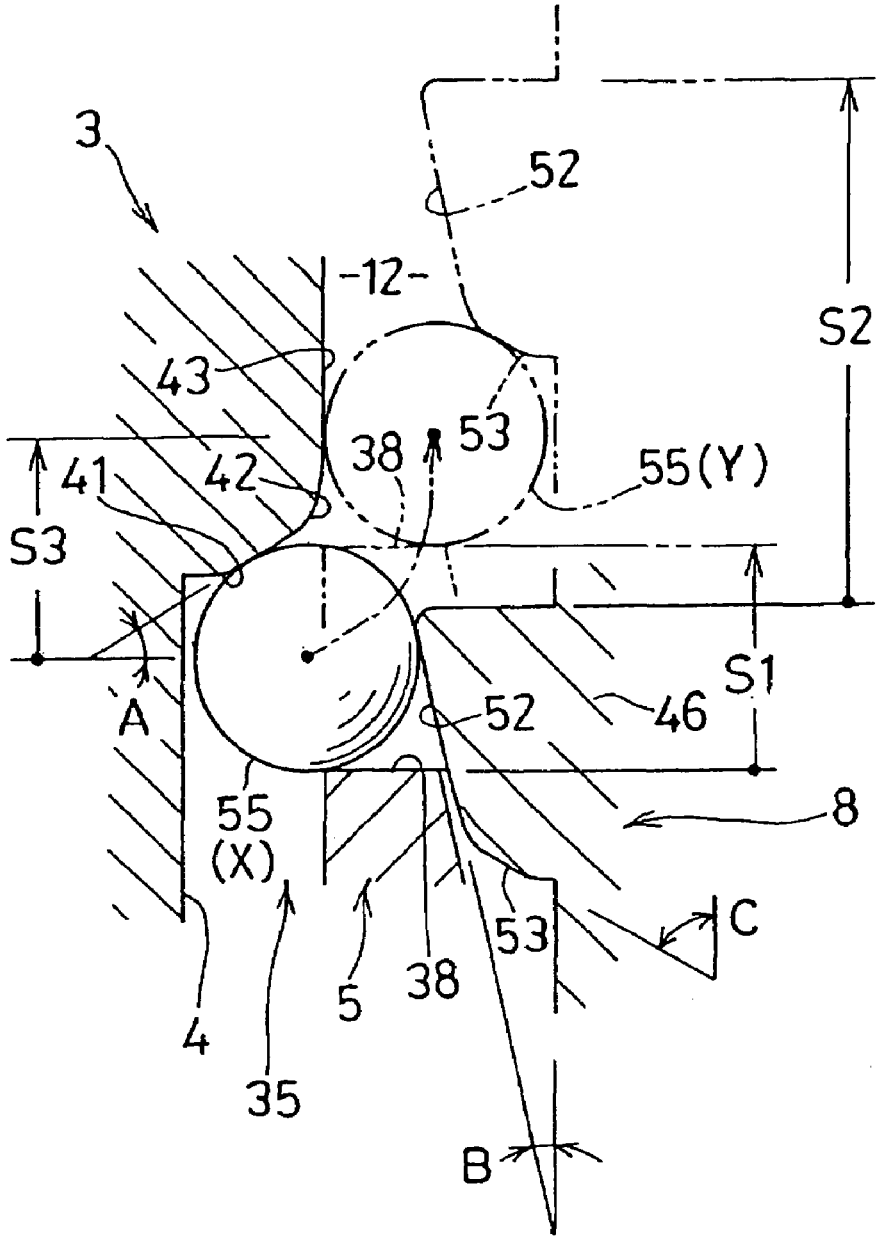
FIG. 3 is a working explanatory view of a stroke enlargement mechanism provided in the clamp.

FIG. 1 through FIG. 3 show an embodiment according to the present invention. In this embodiment, it is illustrated that the present invention is applied to a link-type clamp.

An entire structure of the link-type clamp is first described as follows with reference to FIG. 1 and FIG. 2.

A housing 3 of the clamp 2 is inserted into an installation hole 1*a* of a table 1 of a machine tool, and the housing 3 is fixed to an upper surface of the table 1 by a plurality of bolts (not shown in the figures).

Into a cylindrical hole 4 of the housing 3 is inserted an annular piston 5 via a first sealing member 6 hermetically and axially movably. Into a cylindrical hole 5*a* of the annular piston 5 is inserted a lower sealing portion 8*a* of an output rod 8 via a second sealing member 9 hermetically and axially movably.

Between a lower end wall (a base end wall) 3*a* of the housing 3 and the annular piston 5 is formed a lock chamber 11, and between an upper end wall (a leading end wall) 3*b* of the housing 3 and the annular piston 5 is formed a release chamber 12. A compression coil spring 14 is attached to the lock chamber 11, and the spring 14 is adapted to move the annular piston 5 upward (toward a leading end direction) for locking. A supply and discharge port 16 for pressurized oil is arranged to communicate with the release chamber 12. The pressurized oil (pressurized fluid) supplied to the release chamber 12 is adapted to move the annular piston 5 downward (toward a base end direction) for releasing.

A lower half portion of the output rod 8 is inserted into a pipe 18 arranged in the lock chamber 11. An internal space of the pipe 18 communicates with the outside of the housing 3 via a breathing passage 19 formed in the lower end wall 3*a*. In the breathing passage 19 is provided a trap valve 20. The trap valve 20 has a function of discharging the pressurized oil that leaked out of the release chamber 12 into the lock chamber 11 to the outside of the housing 3, and herein, the trap valve 20 employs a spring-closing type check valve.

An upper portion of the output rod 8 is inserted into the upper end wall 3*b* of the housing 3 hermetically and movably. A sectional area of an upper sealing portion 8*b* of the output rod 8 in the upper end wall 3*b* is set to a value smaller than that of the lower sealing portion 8*a* in the annular piston 5.

A clamping arm 22 is arranged above the housing 3. To a longitudinal middle portion of the clamping arm 22 is rotatably connected an upper end portion of a link member 23 via an upper pin 24, and a lower portion of the link member 23 is rotatably connected to the upper end wall 3*b* via a lower pin 25. An input portion 22*a* of the clamping arm 22 is rotatably connected to an output portion 28 on the upper end of the output rod 8 via an output pin 29. To an output portion 22*b* on a leading end of the clamping arm 22 is screwed a pressing bolt 31.

In the release chamber 12 is provided a stroke enlargement mechanism 35. The stroke enlargement mechanism 35 is described as follows based on FIG. 3 with reference to FIG. 1 and FIG. 2. FIG. 3 is a working explanatory view of an enlarged main part of FIG. 1. In FIG. 3, the solid lines show a released state, and the alternate long and two short dash lines show a locked state.

An annular pressing surface 38 is projected upward from an upper end portion of the annular piston 5. On an inner periphery of a sleeve 39 forming a peripheral wall of the release chamber 12 are provided a first tapered surface (a first inclined surface) 41, which narrows upward, an arc surface 42 and a guide surface 43, which vertically extends, in the recited order upward. Furthermore, at a middle height portion of the output rod 8 is provided a truncated cone-shaped input portion 46. On an outer periphery of the input portion 46 are provided a second tapered surface (a second inclined surface) 52, which narrows downward, and an input surface 53, which narrows downward in a tapered manner, in the recited order downward. In the released state shown by the solid lines in FIG. 3 (and FIG. 1), between the pressing surface 38, the first tapered surface 41 and the second tapered surface 52 are inserted a plurality of balls (rolling members) 55 circumferentially at intervals.

The link-type clamp 2 with the above-described structure operates as follows.

In the released state illustrated in FIG. 1 (also illustrated by the solid lines in FIG. 3), pressurized oil is supplied to the release chamber 12. Thereby, the pressurized oil in the release chamber 12 makes the annular piston 5 descend against the compression coil spring 14, and the pressurized oil makes the output rod 8 descend by making the pressure of the pressurized oil act on an annular sectional area, which corresponds to a difference between a sectional area of the lower sealing portion 8*a* of the output rod 8 and that of the upper sealing portion 8*b* of the output rod 8, by which the input portion 46 makes the balls 55 descend to a release position X. Therefore, the clamping arm 22 swings counterclockwise around the upper pin 24, and the pressing bolt 31 gets spaced far away from a work W.

It is noted that the annular piston 5 is prevented from descending by more than a predetermined range by means of the pipe 18.

To switch the released state illustrated in FIG. 1 to the locked state, it is only required to discharge the pressurized oil in the release chamber 12. Then, as illustrated in FIG. 2 (also illustrated by the alternate long and two short dash lines in FIG. 3), the compression coil spring 14 makes the annular piston 5 ascend, the pressing surface 38 moves the balls 55 upward and radially inward via the first tapered surface 41, and the balls 55 moves the output rod 8 upward via the second tapered surface 52. This makes an ascending stroke (a moving stroke) S2 of the output rod 8 larger than an ascending stroke (a moving stroke) S1 of the annular piston 5, by which an expanding amount of the compression coil spring 14 becomes smaller than the ascending stroke S2 of the output rod 8. Then, due to the ascent of the output rod 8, the output portion 28 swings the clamping arm 22 clockwise around the upper pin 24, by which the pressing bolt 31 is brought into contact with an upper surface of the work W.

It follows that the compression coil spring 14 with the small expanding amount and a large urging force presses the input surface 53 of the output rod 8 upward via the pressing surface 38 and the balls 55, which are in a lock position Y, and the output portion 28 of the output rod 8 strongly presses the work W via the clamping arm 22 and the pressing bolt 31.

It is noted that the alternate long and short dash line in FIG. 3 shows the locus of the movement of the ball 55 from the release position X to the lock position Y.

Incidentally, in this embodiment, an angle A of gradient of the first tapered surface 41 is set to about 30 degrees, and an angle B of gradient of the second tapered surface 52 is set to about 13 degrees, whereby the stroke enlarging ratio (=speed increasing ratio) of the ascending stroke S2 of the output rod 8 to the ascending stroke S1 of the annular piston 5 is set to approximately 2.9.

It is noted here that the pressing surface 38 is formed by a plane, and the ascending stroke S1 of the annular piston 5 is set to the same value with the ascending stroke S3 of the balls 55. An angle C of gradient of the input surface 53 is set to about 60 degrees.

It is noted that the locked state in FIG. 2 is switched to the released state in FIG. 1 in the reverse order of the procedures described above. In detail, in the locked state shown in FIG. 2, the pressurized oil is supplied to the release chamber 12, by which, as illustrated in FIG. 1, the pressurized oil makes the annular piston 5 descend and makes the output rod 8 descend, and the input portion 46 of the output rod 8 switches the balls 55 to the release positions X.

Figure 4:
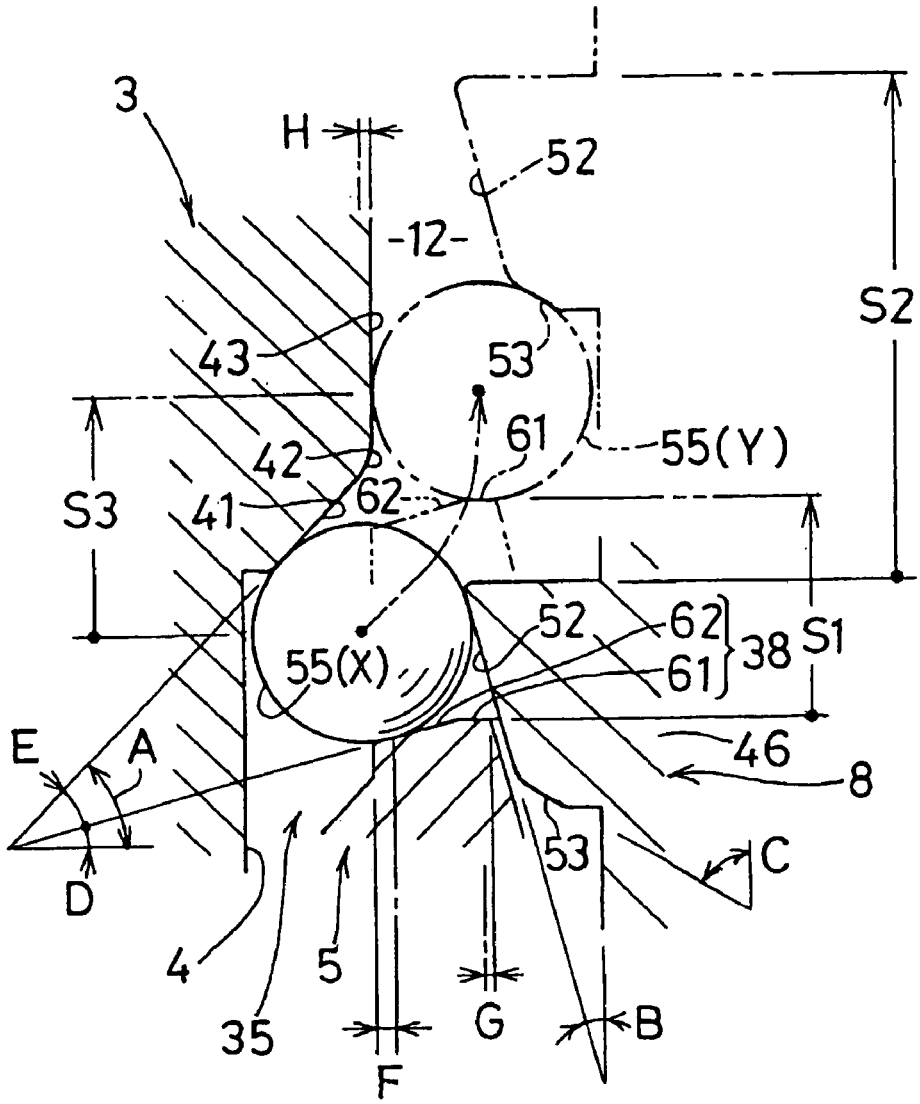
FIG. 4 is a view similar to FIG. 3, illustrating an exemplary variation of the stroke enlargement mechanism.

FIG. 4 is a view similar to FIG. 3, showing an exemplary variation of the stroke enlargement mechanism. In this exemplary variation, components similar to those of the above-mentioned embodiment will be designated and described by the same numerals as a general rule.

The exemplary variation illustrated in FIG. 4 is different from the structure illustrated in FIG. 3 in the following points.

The pressing surface 38 is formed by a plane portion 61 on the radially inner side and a tapered portion 62 on the radially outer side, and the tapered portion 62 is formed in such a manner as to narrow upward. Herein, an angle D of gradient of the tapered portion 62 is set to about 15 degrees. The angle A of gradient of the first tapered surface 41 is set to about 45 degrees. Thereby, an angle E between the tapered portion 62 and the first tapered surface 41 is set to about 30 degrees.

According to the structure illustrated in FIG. 4, an outside dimension F at a contact point between the ball 55 in the release position X and the tapered portion 62 increases, by which the balls 55 can be reliably driven. In addition, a locking-use pressing dimension G between the center of the ball 55 in the lock position Y and an inner peripheral end of the plane portion 61 also increases, by which the ball 55 can be strongly driven for locking. Furthermore, a projecting dimension H from the center of the ball 55 in the release position X to the guide surface 43 decreases, by which the housing 3 can be compact in size.

It is noted that, the tapered portion 62 is provided on the pressing surface 38, by which the ascending stroke S3 of the ball 55 becomes larger than the ascending stroke S1 of the annular piston 5. Thereby, when the output rod 8 is moved upward for locking, the expanding amount of the spring 14 (see FIG. 1 or FIG. 2) is set further smaller compared with the moving stroke of the output rod 8, which enables a work or the like to be locked with a larger urging force of the spring 14.

The above-described embodiment and exemplary variation can be changed as follows.

On the inner periphery of the peripheral wall of the release chamber 12 may be provided a plurality of inclined surfaces circumferentially at intervals instead of the first tapered surface 41. In addition, on the outer periphery of the output rod 8 may be provided a plurality of inclined surfaces circumferentially at intervals instead of the second tapered surface 52. Furthermore, the input surface 53 on the outer periphery of the output rod 8 may be a plurality of inclined surfaces arranged circumferentially at intervals or a plane instead of the tapered surface presented as an example.

It is noted that, in the case that a plurality of the inclined surfaces are provided as mentioned above, each of the inclined surfaces is preferably formed by a bottom wall of an inclined groove.

The rolling member may be a spherical roller or a straight roller or the like instead of the ball 55 presented as an example.

It is sufficient that the stroke enlargement mechanism 35 of the present invention is composed so that the ascending stroke S2 of the output rod 8 is set larger than the ascending stroke S1 of the annular piston 5, and it is matter of course that the angles A, B, C and D of gradient can take various values.

The guide surface 43 may be a gently tapered surface instead of the illustrated straight surface. This case provides such an advantage that the locking force of the spring 14 can be constant.

The arc surface 42 is replaceable by other types of curved surfaces.

The present invention is preferably applied to the link-type clamp presented as an example, however, in place of this, the present invention is also applicable to other types of clamping apparatuses including a rotating clamp and a work support and the like.

The locking-use spring may be composed of other types of springs such as a plurality of coned disc springs laminated vertically instead of the compression coil spring 14 presented as an example.

The output member 8 may be a cylindrical rod instead of the solid rod presented as an example. The output member 8 may project downward and hermetically penetrate the lower end wall 3*a* of the housing 3, instead of or in addition to projecting upward and hermetically penetrating the upper end wall 3*b* of the housing 3.

The releasing-use pressurized fluid may employ another kind of liquid instead of the pressurized oil presented as an example, and furthermore, may employ a gas such as compressed air and the like.

What is claimed is:

1. A spring-lock type clamping apparatus, wherein an annular piston (5) is inserted into a housing (3) hermetically and axially movably, and an output member (8) is inserted into the annular piston (5) hermetically and axially movably, a lock chamber (11) is formed between the annular piston (5) and a base end wall (3*a*) of the housing (3), a release chamber (12) is formed between the annular piston (5) and a leading end wall (3*b*) of the housing (3), a spring (14) attached to the lock chamber (11) is adapted to move the annular piston (5) toward a leading end for locking, a pressurized fluid supplied to the release chamber (12) is adapted to move the annular piston (5) toward a base end for releasing, a pressing surface (38) is provided on a leading end portion of the annular piston (5), a first inclined surface (41), which gets closer to the axis toward the leading end, is provided on an inner periphery of a peripheral wall of the release chamber (12), a second inclined surface (52), which gets closer to the axis toward the base end, is provided on an outer periphery of the output member (8), a plurality of rolling members (55) are inserted between the pressing surface (38), the first inclined surface (41) and the second inclined surface (52) circumferentially at intervals, when the spring (14) moves the annular piston (5) toward the leading end for locking, the pressing surface (38) moves each rolling member (55) toward the leading end and radially inward via the first inclined surface (41), and each rolling member (55) moves the output member (8) toward the leading end via the second inclined surface (52), whereby a moving stroke (S2) of the output member (8) is set larger than a moving stroke (S1) of the annular piston (5) during the locking movement, followed by that the spring (14) is adapted to press an input surface (53) on an outer periphery of the output member (8) toward the leading end via the pressing surface (38) and the rolling members (55).

2. The spring-lock type clamping apparatus as set forth in claim 1, wherein the first inclined surface (41) is formed by a tapered inner peripheral surface, the second inclined surface (52) is formed by a tapered outer peripheral surface, and the rolling members (55) are composed of balls or rollers.

3. The spring-lock type clamping apparatus as set forth in claim 1, wherein the output member (8) is hermetically inserted into the leading end wall (3*b*) of the housing (3), a sectional area of a sealing portion (8*b*) of the output member (8) in the leading end wall (3*b*) is set to a value smaller than that of a sealing portion (8*a*) of the output member (8) in the annular piston (5).

4. The spring-lock type clamping apparatus as set forth in claim 1 or 2, wherein a clamping arm (22) is arranged on the outside of the leading end wall (3*b*) of the housing (3), a leading end portion of a link member (23) is rotatably connected to a longitudinal middle portion of the clamping arm (22), a base end portion of the link member (23) is rotatably connected to the leading end wall (3*b*), and an input portion (22*a*) of the clamping arm (22) is rotatably connected to an output portion (28) on the leading end of the output member (8).

* * * * *